US010679810B2

(12) United States Patent
Zampicinini

(10) Patent No.: US 10,679,810 B2
(45) Date of Patent: Jun. 9, 2020

(54) ELECTRIC RELAY STRUCTURE

(71) Applicant: VIMAR S.P.A., Marostica (VI) (IT)

(72) Inventor: Giorgio Zampicinini, Arcole (IT)

(73) Assignee: VIMAR S.P.A., Marostica (VI) (IT)

( * ) Notice: Subject to any disclaimer, the term of this patent is extended or adjusted under 35 U.S.C. 154(b) by 283 days.

(21) Appl. No.: 15/739,979

(22) PCT Filed: Jun. 22, 2016

(86) PCT No.: PCT/IB2016/000877
§ 371 (c)(1),
(2) Date: Dec. 26, 2017

(87) PCT Pub. No.: WO2016/207713
PCT Pub. Date: Dec. 29, 2016

(65) Prior Publication Data

US 2018/0190457 A1 Jul. 5, 2018

(30) Foreign Application Priority Data

Jun. 23, 2015 (IT) ..... 102015000026761

(51) Int. Cl.
*H01H 47/00* (2006.01)
*H01H 47/22* (2006.01)
*H01H 47/04* (2006.01)
*H01H 13/50* (2006.01)

(52) U.S. Cl.
CPC ..... *H01H 47/001* (2013.01); *H01H 47/043* (2013.01); *H01H 47/223* (2013.01); *H01H 47/226* (2013.01); *H01H 13/50* (2013.01)

(58) Field of Classification Search
CPC .... H01H 13/50; H01H 47/001; H01H 47/043; H01H 47/223; H01H 47/226
USPC ..... 361/155
See application file for complete search history.

(56) References Cited

U.S. PATENT DOCUMENTS 3,174,080 A 3/1965 Scott
3,931,551 A 1/1976 Holt

FOREIGN PATENT DOCUMENTS

DE 1911780 A1 10/1969
DE 4336328 A1 4/1995

OTHER PUBLICATIONS

International Search Report for PCT/IB2016/000877 dated Oct. 6, 2016.

(Continued)

*Primary Examiner* — Kevin J Comber
(74) *Attorney, Agent, or Firm* — Hedman & Costigan, P.C.; James V. Costigan; Kathleen A. Costigan

(57) ABSTRACT

A step-by-step electric relay structure of a bistable type, comprising a mechanical part and an electric part, the mechanical part comprising push-button means to be operated by a user and the electric part comprising coil means, capacitor means, resistor means and diode means operatively interconnected to one another, the coil means comprising either two coils coupled in parallel to one another or a single coil polarized or biased with two polarities, thereby, as the push-button means are operated by the user to provide a switching or exchanging of at least a contact of the relay structure, either one of the two coils is shorted or the two polarities of the single coil are mutually reversed, thereby providing the electric relay structure with a logic SET function and a logic RESET function.

6 Claims, 6 Drawing Sheets

(56) References Cited

OTHER PUBLICATIONS

English Machine Translation of Description for DE 1911780 A1 dated Oct. 9, 1969.
English Abstract for DE 4336328 A1 dated Apr. 27, 1995.

Switching step to SET (A)

Switching step to RESET (B)

Single biased coil relay trace, with the positive pulse indicating the SET status and the following negative pulse the RESET status

ELECTRIC RELAY STRUCTURE

BACKGROUND OF THE INVENTION

The present invention relates to a step-by-step electric relay structure.

As is known, a relay is a device which, upon sensing a variation occurred in a power supply or drive circuit, provides a consequent variation of one or more driven circuits, thereby allowing to use a small power drive signal to operate a driven circuit of even a much larger power.

Also known is the fact that the mentioned relays may be considered as pertaining to three main classes, that is electric, electromechanical and electronic relays (without considering thermal relays or electrodes and the like).

An electric relay is that in which the power supply circuit and the driven circuits are exclusively of an electric type: these electric relays have several advantages, among which that of omitting to use delicate active electronic components, but using only resistances, capacitors and diodes which do not consume a substantial electric power.

Moreover, an electric relay is a very noiseless one and may also operate directly by 220 Vac, and it may be moreover coupled as a conventional electromechanic three-wire step-by-step relay.

Moreover, it has "clean" contacts, that is non solid status contacts, with a very high switching capability, and being practically insensitive to shorts.

An electromechanical relay, in turn, is an electric relay consisting of an electromagnet sensitive to the supply current strength variation, and which, by operating on a soft iron movable armature, will cause one or more contacts to be either opened or closed.

Such an electromechanical relay, while having a good structural strength and being adapted to satisfactorily operate both for large and small switching currents, has, however, a large size, a high operating noise and a high switching power consume, that is a high operation power.

An electronic relay, finally, is a relay using solid status electronic components, such as silicon controlled transistors and diodes, and has a small size and operates in a flexible and noiseless mode of operation.

However, such an electronic relay is very sensitive to voltage peaks and high currents, and, since it includes a solid status end stage, it may, for example, be "burned" if the coupled load is shorted.

Notwithstanding the above mentioned drawbacks of the electronic relays, at present the relay technology seems to be oriented to a continuous development of said electronic relays, to the detriment (obviously) of electromechanical relays and even of electric relays, which seems to the Applicant not to be justified, in view of the above mentioned great advantages, and yet other advantages, of the electric relays, even compared to the electronic ones.

SUMMARY OF THE INVENTION

Accordingly, the aim of the present invention is to provide an improved electric relay structure, combining all the above mentioned advantages of electric relays and substantially all the above mentioned advantages of electronic relays, while eliminating all the above mentioned drawbacks of the latter.

Within the scope of the above mentioned aim, a main object of the present invention is to provide such an electric relay structure, of a step-by-step type, which is very reliable in operation, of small size and noiseless, and which does not comprise any active electronic component and with a very small number of passive electric components.

Another object of the present invention is to provide such a step-by-step electric relay structure which also comprises the SET and RESET functions, without requiring outer units for performing these functions, such as for example in the domotics field.

Yet another object of the present invention is to provide such a step-by-step electric relay structure which may be connected to a plurality of corresponding or like relays thereby providing an electric relay assembly adapted to be driven by a single command.

Yet another object of the present invention is to provide such a step-by-step electric relay structure which is adapted to replace all the breakers and switches of conventional electric systems, so as to be easily controlled through conventional controlling push-button assemblies.

Yet another object of the present invention is to provide such a step-by-step electric relay structure which also comprises memory or storage capabilities thereby being able to make, for example, small central control units for electric motors for blinds/shutters and/or the like.

Yet another object of the present invention is to provide such a step-by-step electric relay structure which may be made of commonly commercially available materials and which does not require substantial maintenance operations and which, moreover, is very competitive from a mere economic standpoint.

According to one aspect of the present invention, the above mentioned aim and objects, as well as yet other objects, which will become more apparent hereinafter, are achieved by a step-by-step electric relay structure of a bistable type, comprising a mechanical part and an electric part, said mechanical part comprising push-button means to be operated by a user and said electric part comprising coil means, capacitor means, diode means and resistor means operatively interconnected to one another, characterized in that said coil means comprise either two coils connected in parallel to one another or a single coil polarized or biased with two polarities, thereby, as said push-button means are operated by said user to cause a switching or exchange of at least a contact of said relay structure, either one of said coils is short-circuited or said two polarities of said single coil are mutually reversed, thereby providing said electric relay structure with a SET and RESET logic function.

BRIEF DESCRIPTION OF THE DRAWINGS

Further characteristics and advantages of the electric relay structure according to the present invention will become more apparent hereinafter from the following detailed disclosure of some currently preferred embodiments thereof which are illustrated, by way of an indicative but not limitative example, in the accompanying drawings, where.

DESCRIPTION OF THE PREFERRED EMBODIMENTS

Figure 1:
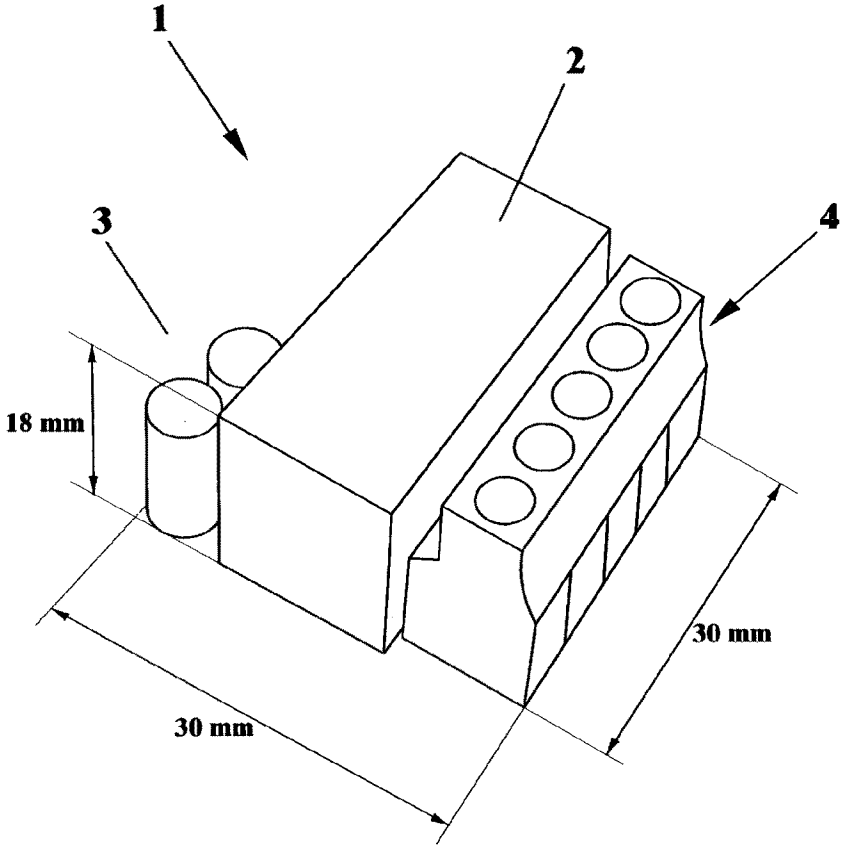
FIG. 1 is a perspective view, on an enlarged scale, of a possible preferred embodiment of the electric relay structure, according to the present invention, in which is clearly shown the very small size (in the order of few millimeters) of said electric relay structure.

With reference to the above mentioned figures, in particular FIG. 1, the electric relay structure according to the present invention has been generally indicated by the reference number 1 and has been included to clearly show the very small size, in the order of a few tens of millimeter (substantially corresponding to the size of a conventional electronic relay), of the electric relay structure, according to the present invention.

In this embodiment are clearly shown the box body 2 containing the main electric components of the electric relay structure according to the present invention, with an outer capacitor assembly 3 and an outer driving assembly generally indicated by the reference number 4.

Figure 2:
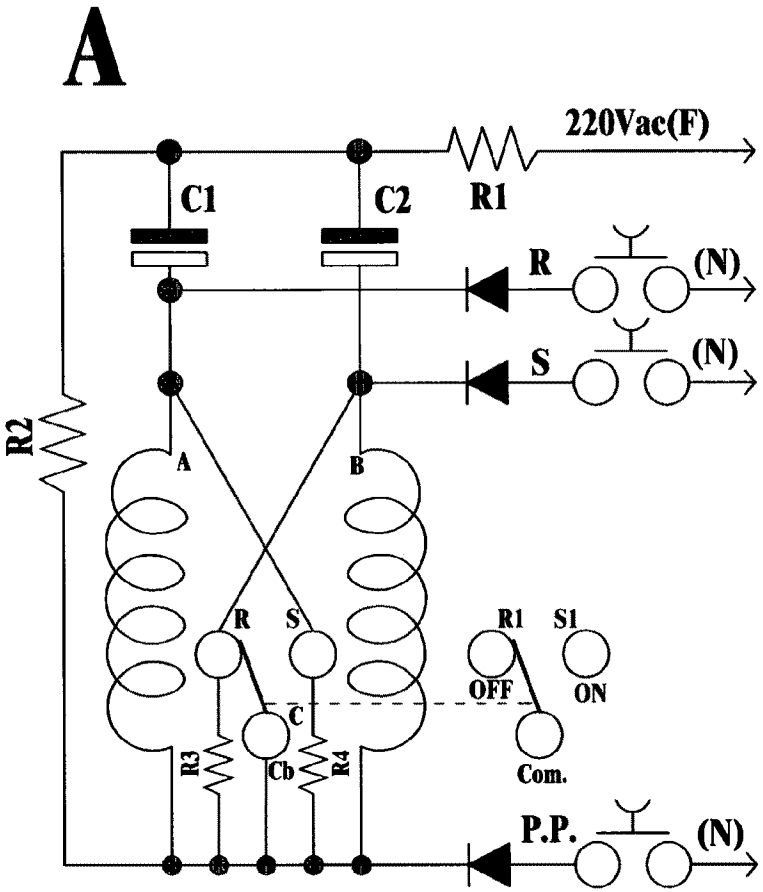
FIG. 2 shows a detailed circuit diagram of an embodiment of the electric relay structure, according to the present invention.

FIG. 2 shows a detailed electric diagram A of a possible embodiment of the electric relay structure according to the present invention.

In this diagram, the resistor R1 is used to limit the loading current in order to prevent the push-buttons from being damaged.

More specifically, by pressing the push-button P.P., the capacitors C1 and C2 start to be simultaneously charged with an operation difference, that is the capacitor which must perform the exchange (C1) causes current to pass through the coil A, whereas the other capacitor (C2) is charged substantially immediately since the exchanging contact will short the coil B which must not operate.

The resistors or resistances R3 and R4 operate so as to prevent other bouncing or back switchings from occurring if, during the switching, the capacitors C1 and C2 have not yet been fully charged, thereby taking thereon the non-completed charge residues.

The resistor R2 is provided to adjust, in combination with the capacitors C1 and C2, the number of seconds which must lapse from a command PP to the other.

The Applicant has advantageously provided switching times from 0.1 sec to 15 sec, which, on the other hand, can be suitably selected by suitably choosing, as it will be clear to one skilled in the art, the values of the resistor R2 and the capacitors C1 and C2.

Thus, by pressing R, independently of the position of the contacts, a switching to an OFF status will be always provided.

Vice versa, by pressing S, independently of the position of the contacts, a switching to an ON status will be always achieved.

It is advantageously provided herein that the operation voltage ranges from 160 Vac to 260 Vac.

From tests carried out by the Applicant on actual electric relays, it has been found that it is possible to switch on 220V a power of 1,700 W.

Thus, since the coils A and B of the relay, as well as the several components, have a comparatively high impedance, it is possible to drive the device from a distance in the order of kilometers by a conventional wire of 1.5 $mm^2$.

Turning now to disclosing in a detailed manner the circuit connections of the electric relay structure of FIG. 2, said structure comprises a first (C1) and a second (C2) capacitors, each having an end coupled, through a first resistor R1, to a pole of the supply voltage (220 Vac) and the other end coupled to a respective end of the two coils (A, B) each having its other end coupled to ground, between each said other end of each said capacitor (C1, C2) being coupled a respective cathode of a first (R) and a second (S) diodes each having its anode coupled to push-button means (N), the resistor means including said first resistor (R1) coupled to each said end of said capacitors (C1, C2) and to said supply voltage (220 Vac), to limit the charging current of said capacitors (C1, C2), a second resistor (R2) coupled at an end thereof to an end of said first resistor (R1) and at the other end thereof to ground to adjust a switching time from a command to another command, said push-button means (PP) and a third (R3) and a fourth (R4) resistors having a respective end thereof coupled to ground and the other respective end thereof coupled to said respective end of each said capacitor (C1, C2) (R4 to C1 and R3 to C2) for preventing bouncing or back switchings.

Figure 3:
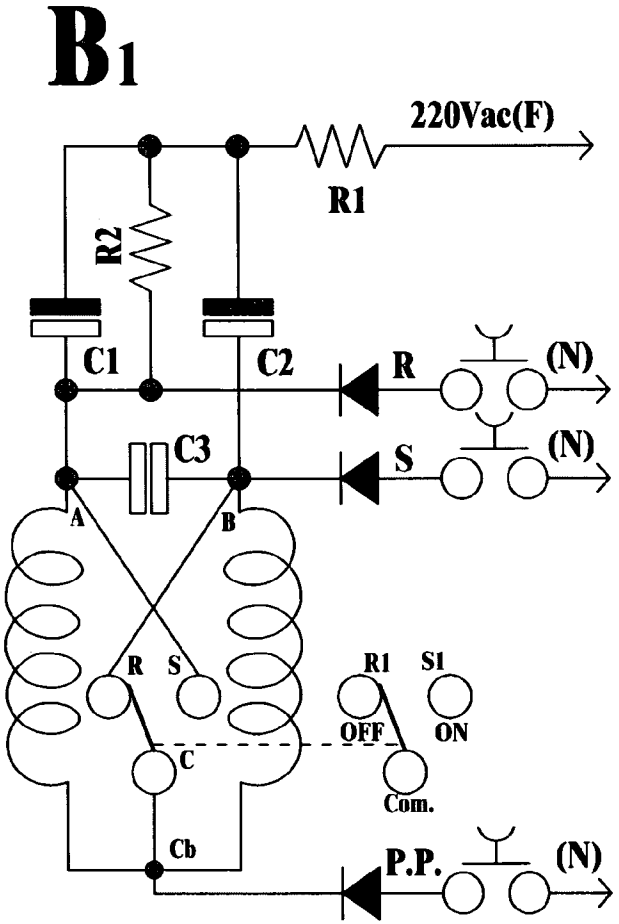
FIG. 3 shows a further detailed circuit diagram of a further possible embodiment of the electric relay structure, according to the present invention.

With reference to FIG. 3, is herein shown a detailed electric diagram B1 of a further embodiment of the electric relay structure according to the present invention, which is substantially based on the logic configuration of the previously disclosed circuit A with an addition, however, of a capacitor C3 which, at the end of any exchanging operation, by reversing its polarity, further enhances the locking of the coil which must be held deactivated or disabled.

In particular, as the push-button P.P. is pressed, the capacitors C1 and C2 start to be charged.

The inner exchange causes the pulse to pass only through the coil (A), the other coil (B) being shorted.

At the end of the exchanging operation, the capacitors C1 and C2 will be substantially charged, whereas C3 will hinder charge residues, by reversing its polarity and discharging on the coil A, thereby further locking the latter.

C3 also operates to solve the problem of the mechanical response times of the relay structures, which may be different depending on their makers.

Said capacitor C3 will also dampen bouncings of the inner contacts (in a number even greater than twenty) which could prevent the relay switching operation.

As the push-button P.P. is released, the capacitors C1 and C2 are discharged for a time established by R1, preferably chosen from 0.1 sec to 15 sec.

Once passed this time, the relay structure according to the present invention will be ready for a further operation.

With a detailed reference to the electric connections, the embodiment of the electric relay structure of FIG. 3 comprises the two coils A and B having respective first ends, i.e. the top ends in FIG. 3, both coupled to the capacitor C3.

To the first end (the top one) of the coil A is coupled a first end of a capacitor C1 having its other end coupled through a resistor (R1) to a power supply voltage 220 Vac.

The other end of the capacitor C1 is coupled to an end of a resistor R2 having its other end coupled to the resistor R1, the other end of C1 being also coupled to a cathode of a diode R having its anode coupled to an end of a push-button (N).

The capacitor C2 has an end coupled to said end of the resistor R1 and its other end coupled to the first end (the top end) of the coil B, which first end is coupled to the cathode of a further diode S having its anode coupled to an end of a further push-button (N).

The two second ends of the coils A, B (the bottom ends) are coupled to one another at Cb pertaining to an exchange contact C which may be switched between a terminal R directly coupled to said end of the coil B and a terminal S directly coupled to said end of the coil A.

The exchange contact C is mechanically coupled to a further exchange contact which may be switched between an OFF position (R1) and an ON position (S1).

Figure 4:
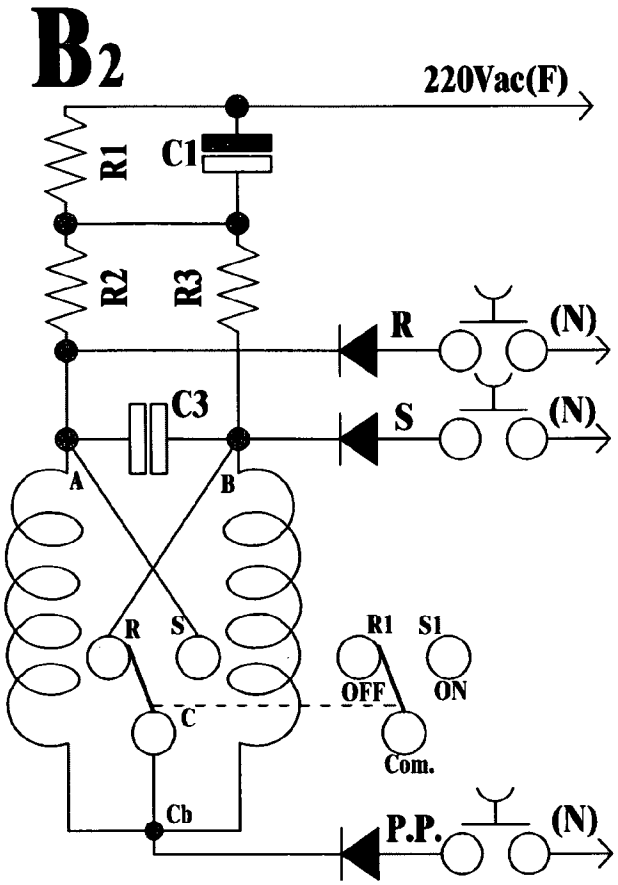
FIG. 4 shows yet another detailed circuit diagram of a further preferred embodiment of the electric relay structure, according to the present invention.

With reference to FIG. 4, is herein shown a further embodiment B2 of the electric relay structure according to the present invention.

In particular, the diagram B2 greatly simplifies the circuit A, by causing a single capacitor C1 to operate between the resistors R1, R2, R3.

By using this single capacitor, it is possible to provide an automatic adjusting of the pulse (0.002 sec) since, at the end of the switching, C1 will not have a sufficient power or energy to perform another exchanging.

More specifically, as the push-button P.P. is pressed, C1 starts to be charged, and the inner exchange or switching may transfer the pulse onto one single coil, while the other is shorted, thereby separating the two coils and limiting the short currents.

At the end of the switching, C1 will be nearly discharged and will not have the capability of performing further command operations.

As the push-button P.P. is released, C1 will be discharged in a time established by R1, and preferably included between 0.1 sec and 15 sec.

After this switching, the relay according to the present invention will be ready to perform a further operation.

C3 has a function of solving the problem of the mechanical response times which may be different depending on the relays (from relay maker to relay maker).

In a practical operation, C3, upon performing the switching, will reverse the polarity and accordingly will further enhance the pulse on the coil which must be exchanged.

It moreover attenuates any bouncings of the inner contacts (even in a number greater than 20) which could prevent the relay switching operation.

In the further embodiment of the electric relay structure B2 of FIG. 4, the two coils (A, B) have their respective (bottom) ends coupled to one another and to a cathode of a first diode having its anode coupled to said push-button P.P., the other respective (top) ends of said coils A, B being coupled to one another through a first capacitor (C3) having an end thereof coupled to said coil A and said supply voltage (220 Vac) through two resistors R2, R1 and the other end coupled to an end of a third resistor (R3) having its other end coupled to an end of a further capacitor C1 having its other end coupled to said power supply voltage, the respective two shared ends of said resistors (R2, R3) being directly coupled to one another.

Figure 5:
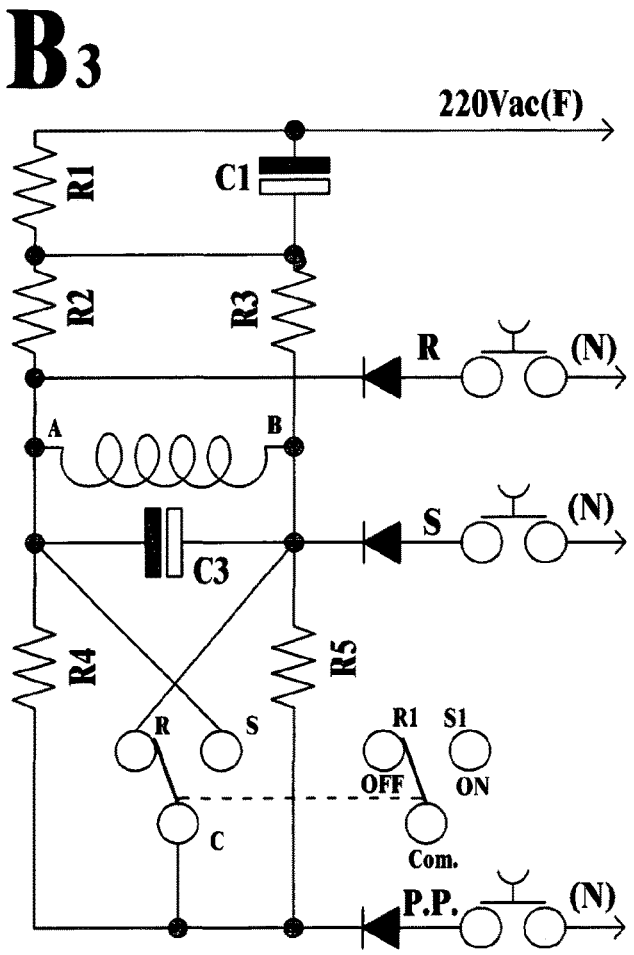
FIG. 5 shows yet another detailed circuit diagram of another preferred embodiment of the electric relay structure, according to the present invention.

With reference to FIG. 5, is herein shown a detailed electric diagram B3 of yet another embodiment of the electric relay structure according to the present invention comprising, according to a main aspect of the invention, a single coil being polarized with different polarities (– and +), thereby is herein provided a circuit with a complementary logic different from that of the other above disclosed diagrams A, B1, B2.

This relay embodiment is designed for switching either on a side or on the other side by reversing the polarity (– and +) on the single coil A-B.

More specifically, as the push-button P.P. is pressed, the capacitor C1 starts to be charged, the inner exchanging or switching shorting the pulse on A and B.

Upon switching, the coil is reversed in polarity, the capacitor C1 being substantially discharged, and accordingly being unable to perform further switching operations, since R4 and R5 will absorb any charge residues.

By pressing again the push-button P.P., the above mode of operation is repeated again but with the coil polarities (+ and –) reversed since the inner exchange this time will cause A to be shorted.

By further pressing the push-button P.P., the capacitor C1 will be discharged with a discharging time established by R1 and by the capacitance of C1 itself, preferably being selected from 0.1 sec to 15 sec.

Once passed this time, the relay structure according to the present invention will be ready for a further operation.

The capacitor C3 has a function of stabilizing the polarity at that time.

More specifically, with reference to the electric connections of the single coil embodiment shown in FIG. 5, the single coil (A, B) has a first end (A) coupled to a first end of a first resistor (R2) having a second end coupled to a first end of a second resistor (R1) having its second end coupled to said power supply voltage (220 Vac), said first end (A) of said coil being moreover coupled to a first end of a third resistor (R4) having its second end coupled to a terminal (C) of an exchange contact which may be switched from a first position (R) to a second position (S), said terminal (C) being coupled to the cathode of a first diode having its anode coupled to a first push-button (P.P.), said terminal (C) of said exchange contact being mechanically coupled to a terminal (Com) of a further exchange contact (C1) which may be switched from an OFF position to an ON position, in parallel to said single coil being coupled a first capacitor (C3) having an end coupled to said first end of said third resistor (R4) and its other end coupled both to the second end (B) of said single coil (A, B) and to an end of a fifth resistor (R5) having its other end coupled to said cathode of said first diode, said second end (B) of said single coil (A, B) being coupled to a first end of a fourth resistor (R3) having the second end coupled to a first end of a second capacitor (C1) having its second end coupled to said power supply voltage (220 Vac), the second end of said first resistor (R2) being shorted to the second end of said fourth resistor (R3), said first end of said first resistor (R2) being directly coupled to the cathode of a second diode (R) whose anode is coupled to a second push-button, said end of said fifth resistor (R5) being coupled both to the cathode of a third diode (S) having its anode coupled to a third push-button and to a terminal (R) of said exchange contact, a further terminal (S) of said exchange contact being coupled both to said first terminal (A) of said single coil and to said first end of said first capacitor (C3).

Figure 6:
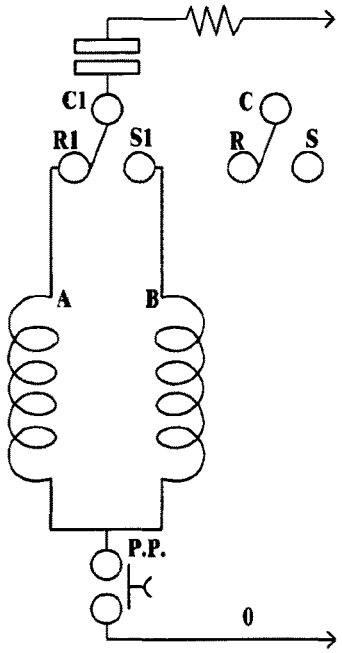
FIG. 6 shows a principle electric diagram useful for understanding the operation of the electric relay structure, according to the present invention.
Figure 7:
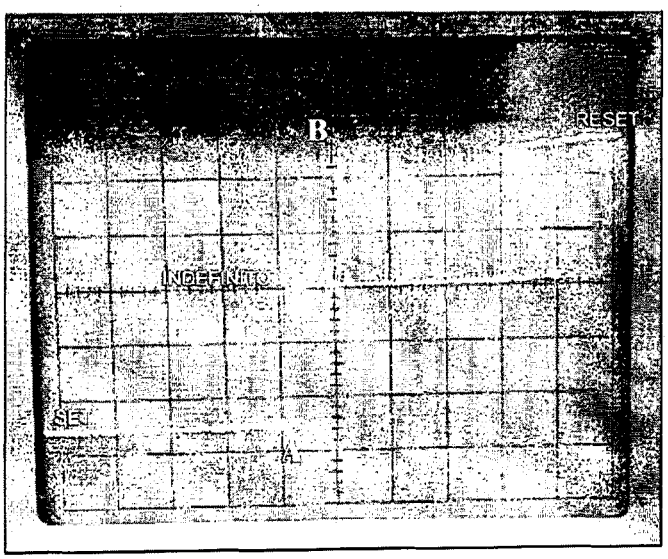
FIG. 7 shows a picture of oscilloscopic traces useful for understanding the operation of the electric relay structure, according to the present invention.
Figure 8:
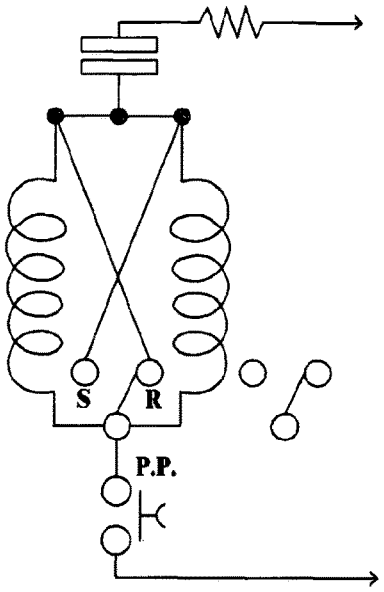
FIGS. 8 and 9 show further principle electric diagrams useful for better understanding the operation of the electronic relay structure, according to the present invention.
Figure 9:
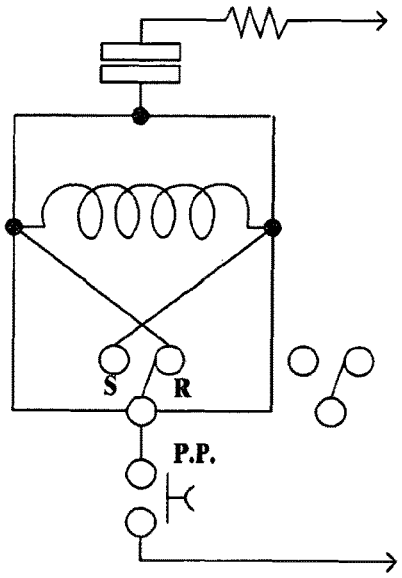
Figure 11:
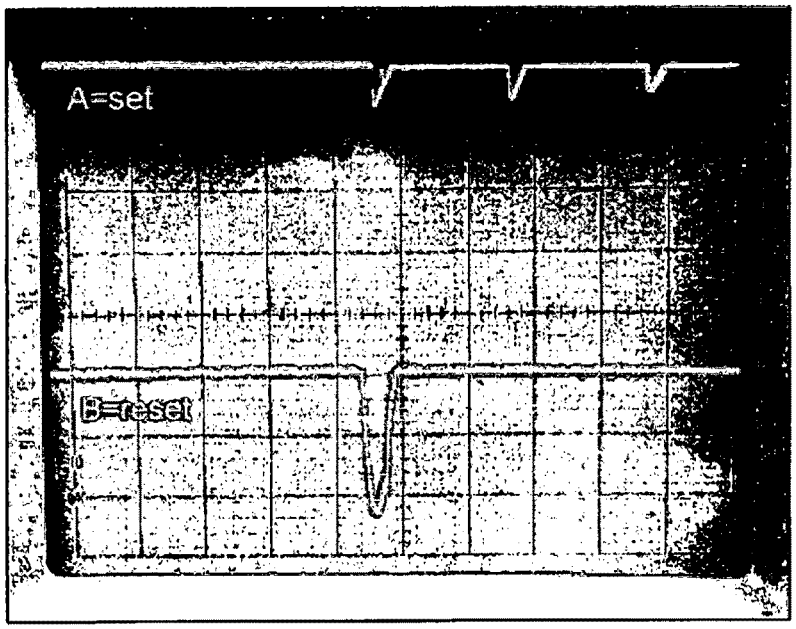
FIG. 11 shows yet another picture of oscilloscopic traces illustrating a switching operating step to a RESET status of the electric relay structure, according to the present invention.
Figure 12:
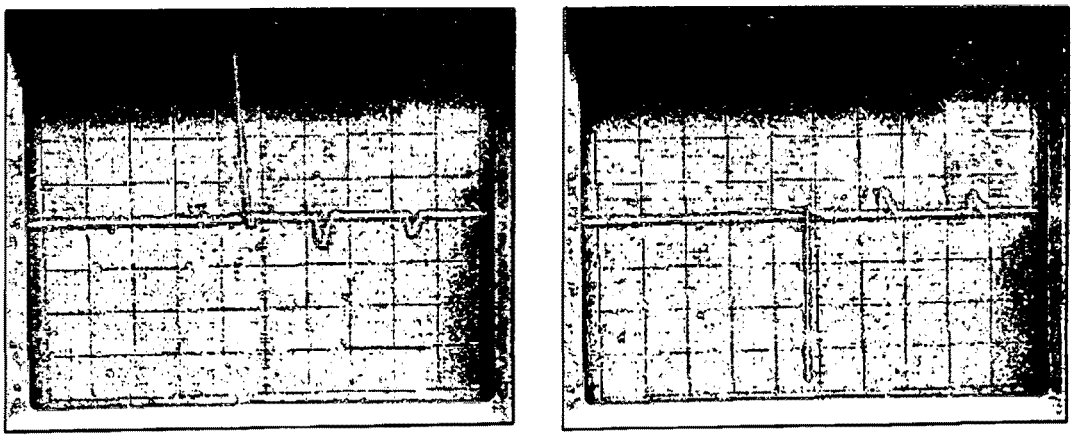
FIG. 12 shows two further pictures of oscilloscopic traces relating to a single polarized coil electric relay structure, with a SET positive pulse in the left picture, and a negative RESET pulse in the right picture, respectively.
Figure 13:
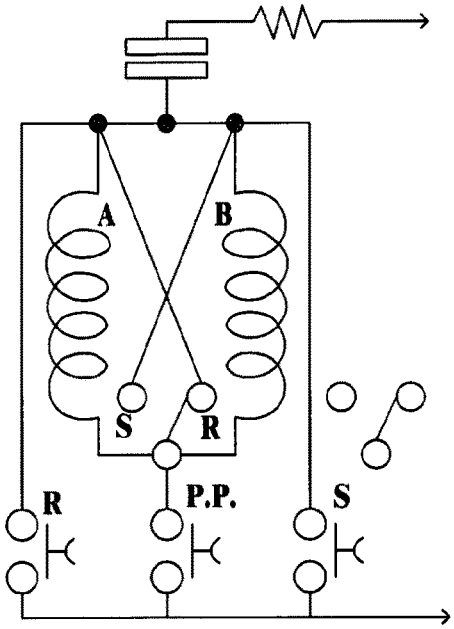
FIGS. 13 and 14 show yet two further principle electric diagrams useful to better understand the operation of the electric relay structure, according to the present invention.
Figure 14:
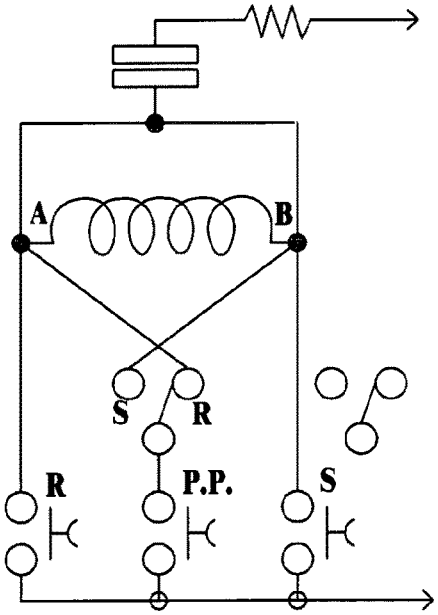

With reference now to FIGS. 6 to 14 (in particular to the principle electric diagram shown in FIG. 6; FIG. 8: FIG. 9; FIG. 13 and FIG. 14), the operation of the embodiments of the electric relay structure according to the present invention, shown in the electric diagrams of the above disclosed FIGS. 2 to 5, will be disclosed in a detailed manner.

As stated, the electric relays are of a bistable type, either with two coils or with a single coil polarized in a DC current with a switching time of 0.001 sec with a double exchanging contact (C-No-Nc).

A two-coil relay, as is known, has the feature that it may remain switched on its last switching operation.

In other words, by supplying through a push-button the coil A, the contact is arranged on SET and is always held in this position, whereas by supplying the coil B it will be arranged on RESET and held therein.

Thus, to switch the relay it would be necessary to have two discrete push-buttons.

This problem becomes much more complex if a single push-button is used for performing the switching.

As a principle diagram (FIG. 6), by using an inner exchanging contact to enable the involved coil, it is possible to achieve the exchanging or switching.

In this connection, it should be pointed out that the relay will switch in about 1/1000 second and its contacts will be subjected to about twenty bouncings for about 4/1000 second and, usually, a person will held the push-button pressed for at least 250/1000 second or more: accordingly, the relay will be caused to oscillate, thus performing a very high number of switching operations instead of only one.

In this regard please see the oscilloscope traces shown in FIG. 7.

Here, by exchanging or switching from SET to RESET, it should be apparent that the contact will start at A and in 0.0008 sec will arrive at B and then will bounce for at least twenty times in an undefined zone and will stabilize after 0.0045 sec.

To provide a stable exchange, it is necessary to cause the system to operate in the portion AB.

To obviate the above problem, it will be sufficient to use different electronic components, for example at least some tens, which must be all supplied with a stabilized voltage thereby generating (independently of the push-button pressing time) a single pulse under 1/1000 second.

To the above it should be added the fact that an electronic circuit, in order not to be overheated, may drive only a solid status relay with all the consequent limitations associated therewith (for example LED bulbs).

Even though electronic step-by-step relay structures with conventional contacts (i.e. non solid status contacts) are commercially available, they must be continuously power supplied, that is by a four-wire arrangement and not by a three-wire arrangement, thereby, in a rest condition, they will consume at least 1 watt, and, when switching off the voltage, they will lose their storing capability, that is will return to zero and will be reset.

Thus, the invention has solved two problems, that is: 1) that of allowing the inventive relay to operate directly at 220 Vac; 2) that of providing a relay structure adapted to self-adjust the pulse.

In logic terms: a single drive or command, a single exchange or switching.

In this connection it should be pointed out that each relay structure has very different switching times and structural parameters, even though the relays are made by the same maker and taken from a same batch.

Thus, the problem solved by the Applicant has been that of "nullifying" or switching off the coil which does not participate at a given time in the exchanging operation, which has been achieved by using a very reduced number of components.

In other words, the relay structure according to the present invention causes the electric part to interoperate with the mechanical part, by shorting the coil which is not involved in the exchanging, thereby allowing the overall system to self-adjust as to the time and modes in passing from a switching operation to another (see for example FIG. 8 and FIG. 9).

The above is just the operating principle based on which the electric relay structure according to the invention operates.

In order to verify the validity of the above principle, on electric relay structures made and practically tested, the Applicant has used a two-trace oscilloscope to simultaneously detect the two voltages applied to the two coils.

Figure 10:
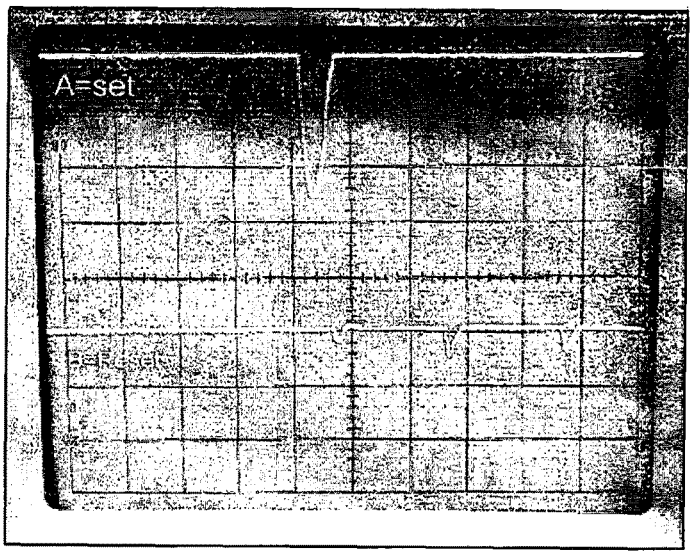
FIG. 10 shows a further picture of oscilloscopic traces relating to a switching operating step to a SET position of the electric relay structure, according to the present invention.

With reference to FIG. 10, the trace A relates to the coil A of a relay switching to a SET or an ON status.

The trace B, on the contrary, relates to the coil B of a relay switching to a RESET or an OFF status.

From the traces of FIG. 10, one skilled in the art will understand that, by pressing the push-button P.P., the coil A will be supplied with voltage, whereas the coil B will not be supplied with voltage since it will be shorted.

See also FIGS. 8 and 9.

Accordingly, the coil A will perform a switching operation and, after about 0.001 sec, will be enabled the coil B, attempting in turn to switch again: however, the pulse is strongly attenuated by the circuit nullifying in actual practice the operation, the very high number of bounces occurring after the exchange being moreover compensated for or disabled.

After 20 milliseconds (that is a time corresponding to a 50 Hz frequency of the mains power supply voltage), the coil B, being in a free condition, will attempt to switch again, but the shorting electric system will have at this time definitively nullified the energy provided by the push-button and the relay will be definitively stabilized, even if the push-button has been pressed for a long time.

By further pressing the push-button, the above disclosed method will be carried out again, but this time with respect to the coil B, as shown in the picture of FIG. 11.

In fact, it can be seen here that the pulse is not a symmetrical one for the two coils, since the two coils operate in a different manner (even if they have a same impedance) because of the hysteresis magnetic phenomenon related to the South and North poles of the magnet.

More specifically, FIG. 11 shows the switching step to RESET (B) whereas FIG. 12 relates to the single polarized coil relay trace: from this trace it can be seen that the pulse is positive in a SET status (picture of FIG. 11), whereas it will become negative for the RESET status (picture of FIG. 12).

With reference to FIGS. 13 and 14, by adding two further drive or command terminals on each coil, it is possible to directly apply to the inventive relay structure the SET and REST conditions, independently of the position of the electric contacts.

Thus, the invention provides a novel electric relay structure which, in a single small-size device which is directly power supplied with a 220 Vac voltage, and fully independent of other driving cards, includes the STEP-BY-STEP, SET and RESET functions.

From the above disclosure of the detailed electric diagrams and the principle electric diagrams of several embodiments of the electric relay structure according to the present invention, it should be apparent that the inventive relay structure operates based on a novel and inventive circuit concept, that is either shorting the coil or a side thereof which does not operate, by transforming a conventional two-coil relay structure, or reversing the polarities of a single polarized or biased coil, thereby providing, in both cases, a very reliable step-by-step relay structure, of a very small size and of noiseless operation, without electronic components and with a very reduced number of passive electric components.

In other words, the invention provides a step-by-step electric relay structure also having SET and RESET functions, without requiring outer control units such as, for example, in a domotics field.

Thus, the invention greatly improves the currently still broadly used conventional step-by-step electric relay structures.

Accordingly, the invention fully achieves the intended aim and objects.

Even though the inventive electric relay structure has been disclosed with reference to currently preferred embodiments thereof, it should be apparent that they are susceptible to several modifications and variations, all coming within the scope of the inventive idea.

The invention claimed is:

1. A step-by-step electric relay structure of a bistable type, comprising a mechanical part and an electric part, said mechanical part comprising push-button means (P.P.) to be operated by a user and said electric part comprising coil means, capacitor means (C1, C2, C3), resistor means (R1-R4) and diode means (R-S) operatively interconnected to one another, characterized in that said coil means (A or B) comprise two coils (A and B) coupled to one another, thereby, as said push-button means are operated by said user to provide a switching or exchanging of at least a contact of said relay structure, said capacitors (C1, C2, C3 or C1 through R1-R3) are charged, and one (A or B) of said two coils (A and B) is shorted, thereby providing said electric relay structure with a logic SET function and a logic RESET function.

2. An electric relay structure, according to claim 1, characterized in that said capacitor means comprise a first (C1) and a second (C2) capacitors each having an end connected to a first end of a first resistor (R1) having its other end connected to a supply voltage terminal (220 Vac), the other end of each said capacitor being connected to a respective end of said two coils (A, B) having their other ends connected to the ground, to each said other end of each said capacitor (C1, C2) being connected a respective cathode of a first (R) and a second (S) diodes each having its anode connected to a said push-button means (P.P.), said resistor means (R1-R3) including said first resistor (R1) connected to each said end of said capacitors and to said supply voltage to limit the charging current of said capacitors (C1, C2), a second resistor (R2) connected between said supply voltage and ground to adjust a passage time between a command and another command of said push-button means (P.P.), and a third (R3) and fourth (R4) resistors having an end thereof connected to ground and the other end thereof connected to said respective end of each said capacitor (C1, C2) to prevent bouncing or back switchings from occurring.

3. An electric relay structure, according to claim 1, characterized in that said electric relay structure further includes a further capacitor (C3) connecting said two ends not connected to the ground of said two coils to further improve the locking of the coil (A or B) which is shorted.

4. An electric relay structure, according to claim 1, characterized in that said two coils (A, B) have their respective ends connected to one another and to the cathode of a first diode having an anode thereof connected to said push-button, the other respective ends of said two coils (A, B) being connected to one another through a first capacitor (3) having an end connected to said a coil (B) and to said supply voltage (220 Vac) through two resistors (R1, R2) and the other end connected to an end of a third resistor (R3) having the other end thereof connected to an end of the further capacitor (C1) having the other end thereof connected to said supply voltage, respective ends of said resistors (R2 and R3) being directly connected to one another.

5. A step-by-step electric relay structure of a bistable type, comprising a mechanical part and an electric part, said mechanical part comprising push-button means (P.P.) to be operated by a user and said electric part comprising coil means, capacitor means (C1, C3), resistor means (R1-R4) and diode means (R-S) operatively interconnected to one another, characterized in that said coil means (A or B) comprise a single coil (A or B) polarized or biased with two polarities, thereby, as said push-button means are operated by said user to provide a switching or exchanging of at least a contact of said relay structure, said capacitors (C1, C3 or C1 through R1-R3) are charged, and said two polarities of said single coil (A or B) are mutually reversed, thereby providing said electric relay structure with a logic SET function and a logic RESET function, said capacitors comprising a first capacitor (C3) connected in parallel to said single polararized or biased coil (A, B), opposite ends of said first capacitor (C3) being connected to respective first and second positions (R,S) of an exchange contact, said resistors comprising a pair of resistors (R4, R5) connected between said opposite ends of said first capacitor (C3) and a terminal (C) of said exchange contact.

6. An electric relay structure, according to claim 5, characterized in that said single polarized or biased coil (A, B) has a first end thereof connected to a first end of the first resistor (R2) having a second end thereof connected to a first end of the second resistor (R1) having its second end connected to said supply voltage (220 Vac), said first end (A) of said coil being moreover connected to a first end of the third resistor (R4) having its second end connected to said terminal (C) of an exchanging contact which may be switched from a first position (R) to a second position (S), said terminal (C) being connected to a cathode of the first diode having its anode connected to a first push-button (P.P.), said terminal (C) of said exchanging or switching contact being mechanically connected to a terminal (Com) of a further exchanging or switching contact which may be switched from an OFF position to an ON position, in parallel to said single coil being connected said first capacitor (C3) having an end thereof connected to said first end of said third resistor (R4) and the other end thereof connected both to the second end (B) of said single coil (A, B) and to an end of a fifth resistor (R5) having the other end thereof connected to said cathode of said first diode, said second end (B) of said single coil (A, B) being coupled to a first end of a fourth resistor (R3) having its second end connected to a first end of a second capacitor (C1) having its second end connected to said supply voltage (220 Vac), the second end of said first resistor (R2) being shorted to the second end of said fourth resistor (R3), said first end of said first resistor (R2) being directly connected to the cathode of a second diode (R) whose anode is connected to a second push-button, said end of said fifth resistor (R5) being connected both to the cathode of a third diode (S) having its anode connected to a third push-button and a terminal (R) of said switching contact, a further terminal (S) of said switching contact being connected to both said terminal (A) of said single coil and to said first end of said first capacitor (C3).

* * * * *